United States Patent [19]

Holland-Letz et al.

[11] 4,406,222

[45] Sep. 27, 1983

[54] PRINTING MECHANISM FOR PRINTING BAR CODES ON PRESSURE-SENSITIVE LABELS ADHERING TO A CARRIER TAPE

[75] Inventors: Günter Holland-Letz; Gerhard Nagel, both of Hirschhorn/N., Fed. Rep. of Germany

[73] Assignee: Esselte Pendaflex Corporation, Garden City, N.Y.

[21] Appl. No.: 290,057

[22] Filed: Aug. 4, 1981

[30] Foreign Application Priority Data

Aug. 8, 1980 [DE] Fed. Rep. of Germany ..... 3030105
Apr. 30, 1981 [DE] Fed. Rep. of Germany ..... 3117231

[51] Int. Cl.[3] ..... B41L 47/46

[52] U.S. Cl. ..... 101/92; 101/375; 101/376; 101/398

[58] Field of Search ..... 101/92, 91, 376, 375, 101/377, 219, 398, 35

[56] References Cited

U.S. PATENT DOCUMENTS

| | | | |
|---|---|---|---|
| 2,323,976 | 7/1943 | Chalmers | 101/92 |
| 2,589,682 | 3/1952 | Dudis | 101/398 X |
| 2,603,153 | 7/1952 | Warren et al. | 101/219 |
| 2,613,598 | 10/1952 | McKay | 101/219 |
| 2,949,079 | 8/1960 | Beattie | 101/35 |
| 3,099,212 | 7/1963 | Sohn | 101/376 X |
| 3,217,639 | 11/1965 | Kelly | 101/91 X |
| 3,381,790 | 5/1968 | Chaveneaud et al. | 101/376 X |
| 3,812,780 | 5/1974 | Borelli | 101/92 X |
| 3,823,665 | 7/1974 | Davis et al. | 101/92 X |
| 3,934,696 | 1/1976 | Mueller et al. | 400/480 X |
| 3,977,319 | 8/1976 | Mogtader | 101/93.18 X |

*Primary Examiner*—Clifford D. Crowder
*Attorney, Agent, or Firm*—Gerald J. Ferguson, Jr.; Joseph J. Baker

[57] ABSTRACT

The present invention relates to a printing mechanism for printing bar codes on pressure-sensitive labels adhering to a carrier tape. The printing mechanism includes a print wheel on which a plurality of type rings rotatable about a common axis relatively to each other are mounted. The carrier tape with the pressure-sensitive labels adhering thereto is pressed with the aid of a pressure roller against the print wheel. To enable the bar codes to be printed to be read without error with electrooptical reading devices, high requirements are made of the printing quality of the bar codes as regards uniformity and contrast. To meet these requirements the type rings comprise a cylindrical peripheral surface on which bar code types of resilient material are formed with which an inking means is in contact; the pressure roller is rotatable about an axis extending parallel to the axis of the type rings and consists of non-resilient material.

13 Claims, 9 Drawing Figures

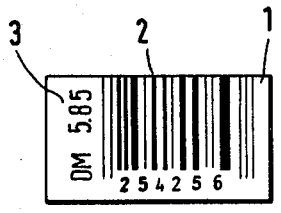
Fig. 1
Fig. 2
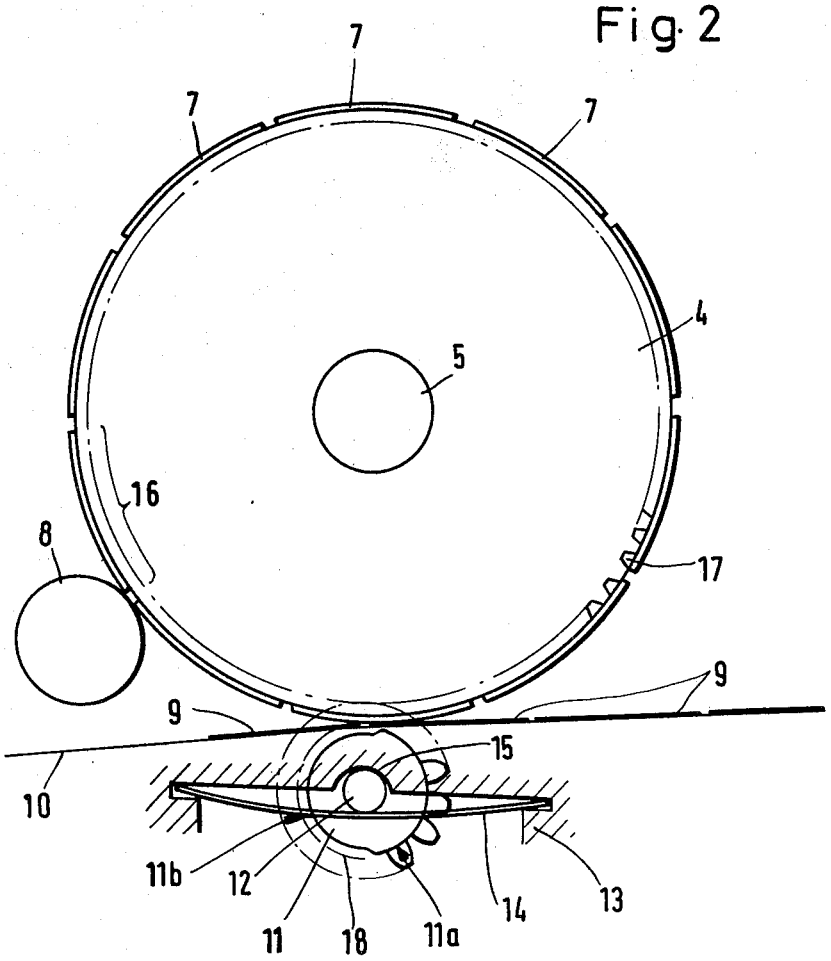

PRINTING MECHANISM FOR PRINTING BAR CODES ON PRESSURE-SENSITIVE LABELS ADHERING TO A CARRIER TAPE

BACKGROUND AND SUMMARY OF THE INVENTION

The present invention relates to a printing mechanism for printing bar codes on pressure-sensitive labels adhering to a carrier tape comprising a print wheel including a plurality of type rings rotatable relatively to each other about a common axis and a pressure roller for pressing the carrier tape with the pressure-sensitive labels adhered thereto against the print wheel.

Such a printing mechanism is already known from DE-PS No. 2,333,155. This known printing mechanism comprises a print wheel which is made up of a plurality of type rings whose periphery has the form of a polygon with ten equally sized straight side faces. On the these straight side faces types formed from metal project each in the form of a bar code element. The bar code elements disposed on the ten straight side faces correspond to the numbers 0 to 9. Since the print wheel is made up of a plurality of type wheels the type rings lying adjacent each other on planar side faces can represent multi-digit numbers in bar code.

In the known printing mechanism a carbon paper tape and a carrier tape with pressure-sensitive labels adhering thereto is led past the side faces of the type rings disposed in a printing position. For pressing the carrier tape with the pressure-sensitive labels and on the carbon paper ribbon against the bar code types on the print wheel a pressure roller is provided which is mounted rotatably about an axis extending perpendicular to the axis of the type rings. For carrying out a printing operation said axis is moved transversely of the print wheel and perpendicularly to the axial direction so that the pressure roller periphery rolls along the surface of the print wheel formed by the planar side faces of the type rings and thereby presses the carrier tape with the pressure-sensitive labels and the carbon paper ribbon against the bar code types. In this rolling operation the carbon paper ribbon produces imprints of the bar code types on the pressure-sensitive label.

As is known, pressure-sensitive labels with bar code types are read with the aid of electrooptical reading devices. However, to enable these reading apparatuses to read the bar code without errors close tolerances must be observed as regards the width and the spacing of the bar code types. A high contrast between printed and unprinted areas on the pressure-sensitive label is also necessary for correct reading.

With the known printing mechanism outlined at the beginning the conditions for satisfactory reading with the aid of an electrooptical reading device can be fulfilled only by overcoming great difficulties. These difficulties start with the manufacture of the type rings themselves because their side faces with the bar code types must be planar to an extremely precise degree. Furthermore, the bar code types of adjacent type rings disposed in the printing position must lie exactly in a plane so that in the printing operation carried out with rolling of the pressure roller on said plane an imprint of the ink from the carbon paper ribbon onto the pressure-sensitive label which is as uniform as possible is obtained. Even if the surfaces of the bar code types lie in only slightly different planes irregular imprints are produced on the pressure-sensitive label and consequently satisfactory reading with the aid of the electrooptical reading device is no longer possible.

The axis of the pressure roller must be guided during its displacement movement transversely of the print wheel with exact spacing from said wheel to obtain a uniform printing of the bar code types over the entire width of the label to be imprinted. Different application pressure intensities produce irregular imprints which lead to erroneous readings. Irregularities in the level of the bar code types and also the guiding of the pressure roller axis could be compensated by using a soft pressure roller surface but it has been found that this results in a decrease in the contrast obtainable on the pressure-sensitive label between the areas which are imprinted and those which are not imprinted. In particular, it is found that when the pressure-sensitive label is pressed from the carrier tape back by means of a soft pressure roller the microroughness present in the surface of the pressure-sensitive label cannot be pressed smooth and consequently surface pores remain uninked. This can be regarded as the cause of defective contrast when using a soft pressure roller.

The objective of the present invention is to provide a pressure mechanism of the type outlined at the beginning such that without excessive expenditure uniform and contrast-rich, i.e. reliably readable, bar codes can be printed.

According to the present invention this is achieved in that the type rings have a circular cylindrical peripheral surface at which bar code types of resilient material are formed, that an inking means is in contact with the bar code types to be printed and that the pressure roller is rotatable about an axis which is parallel to the axis of the type rings and consists of non-resilient material. The type rings from which the print wheel of the printing mechanism according to the invention are made up can, because of their circular cylindrical peripheral surface, be made with simple means to exact dimensions. The use of resilient material for the bar code types permits excellent transfer of the ink taken up by the inking means to the pressure-sensitive labels and the pressure exerted by the pressure roller of non-resilient material may be made so large that by means of the resilient bar code types the ink even penetrates into fine pores of the surface of the pressure-sensitive label. Consequently, even wide bar code types give uniform ink imprints on the pressure-sensitive labels which can be read with great reliability by means of electrooptical reading devices.

BRIEF DESCRIPTION OF THE DRAWINGS

FIG. 1 shows a pressure-sensitive label with a bar code imprint and a clear text imprint as can be printed with the aid of the printing mechanism according to the invention, FIG. 2 is a diagrammatic view of the essential components of the printing mechanism according to the invention.

DETAILED DESCRIPTION OF THE INVENTION

Figure 3:
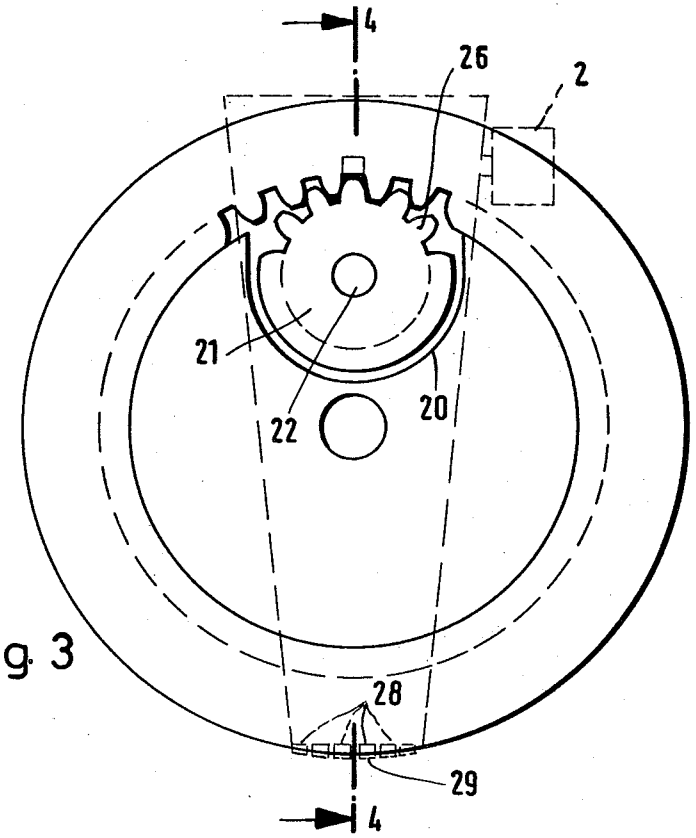
FIG. 3 is a schematic side view of the print wheel with a means for rotating the type rings and a clear text printing mechanism fitted to the print wheel.

In FIG. 1 a pressure-sensitive label 1 is illustrated which is provided with a bar code imprint 2 and a clear text imprint 3. Such pressure-sensitive labels are for example applied in supermarkets with the aid of a hand appliance to the articles to be sold. The clear text imprint 3 shows the customer the price of the article whilst the bar code imprint 2, which is read at the till with the aid of an electrooptical reading device, represents an article number with which the article price is associated in the supermarket data processing system. This article price is then transferred to the cash register to be shown and printed on the sales slip. The cashiers thus no longer need to read the article price and introduce it into the cash register.

A printing mechanism with which a bar code imprint can be produced on a pressure-sensitive label is illustrated diagrammatically in FIG. 2. This printing mechanism includes a printing wheel 4 which is rotatably mounted about a shaft 5. The print wheel 4 includes type rings 6 illustrated in FIGS. 4 and 5 and having a circular cylindrical peripheral surface at which they are provided with bar code types 7. To apply ink to the bar code types 7 to be printed an inking means 8 is provided in the form of a roller rolling on the peripheral surface of the print wheel.

The pressure-sensitive labels 9 to be imprinted adhere to a carrier tape 10 and are moved together with the carrier tape 10 by feed means, not illustrated, tangentially to the print wheel peripheral surface. The pressure-sensitive label 9 is applied to the print wheel 4 with the aid of a pressure roller 11 whose axis 12 extends parallel to the axis 5 of the print wheel 4, which is also the axis about which the type rings 6 are rotatable relatively to each other. The shaft 12 of the pressure roller 11 is biassed in the direction towards the print wheel 4 at both ends with the aid of a leaf spring 14 supported on the printing mechanism housing 13. The shaft 12 is mounted in the printing mechanism housing 13 in such a manner that its path in the direction towards the print wheel 4 is limited by a bearing surface 15 on the printing mechanism housing 13.

As apparent in FIG. 2 the pressure roller 11 comprises a peripheral region 11*a* of large radius and a peripheral region 11*b* of small radius. The large radius is so dimensioned that it is slightly greater than the distance between the centre point of the shaft 12 and the surface of the bar code types 7 on the print wheel 4 whilst the small radius is substantially smaller than this distance. Because of this particular construction of the pressure roller 11 the carrier tape with the pressure-sensitive labels is pressed against the print wheel only when the peripheral portion 11*a* is in a position opposite the print wheel 4. In contrast, if the peripheral portion 11*b* is opposite the print wheel 4 the carrier tape 10 with the pressure-sensitive labels 9 can be freely fed between the print wheel 4 and the roller 11 without any printing operation taking place. In this manner it is achieved that only bar codes types which are in a certain basic position at the start of the printing cycle produce a bar code imprint on a pressure-sensitive label 9. It is assumed in the construction illustrated in FIG. 2 that the bar code types which are to produce an imprint are in the basic position in the sector 16 to the print wheel 4.

Rigidly connected to the print wheel 4 is a toothed wheel 17 which meshes with a tooth wheel 18 mounted on the pressure roller 11. When the print wheel 4 is rotated the pressure roller also rotates synchronously therewith. To keep the drawings clear only a few teeth of these tooth wheels 17 and 18 have been illustrated in each case.

Figure 4:
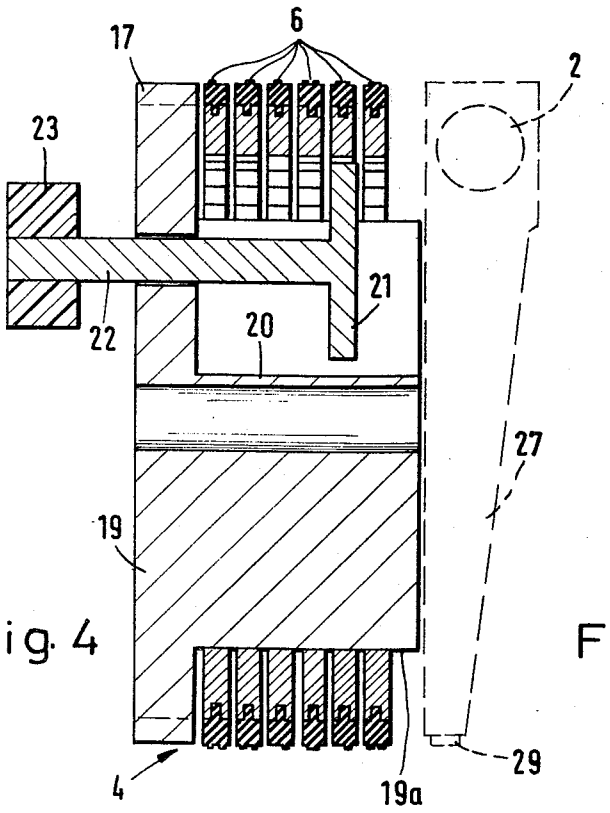
FIG. 4 represents a section along the line 4—4 of FIG. 3 but only the print wheel is shown in section.

The structure of the print wheel is shown exactly in FIGS. 3 and 4.

The print wheel 4 includes a support body 19 having a portion 19*a* of reduced diameter on which the type rings 6 are mounted. The toothed wheel 17 can be formed by providing the outer peripheral surface of the support body 19 with teeth. The tooth wheel 17 could however also be fitted to the support body 19 as a separate part. In the portion 19*a* of the support body 19 a recess 20 is formed in which there is a pinion which is fixed in rotation on a shaft 22 rotatably mounted in the support body 19. On the end of the shaft 22 projecting outwardly from the support body there is a rotating button 23 with the aid of which the pinion 21 can be rotated.

Figure 6:
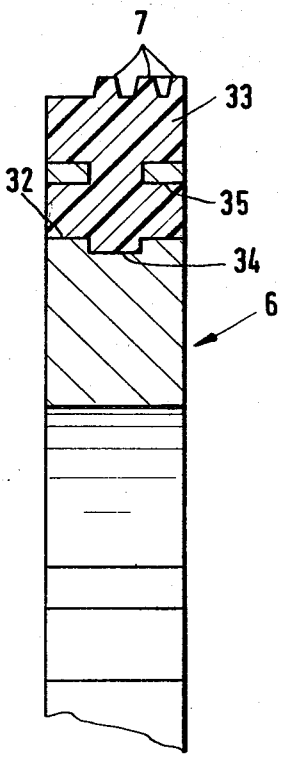
FIG. 6 is an enlarged section along the line 6—6 of FIG. 5.
Figure 5:
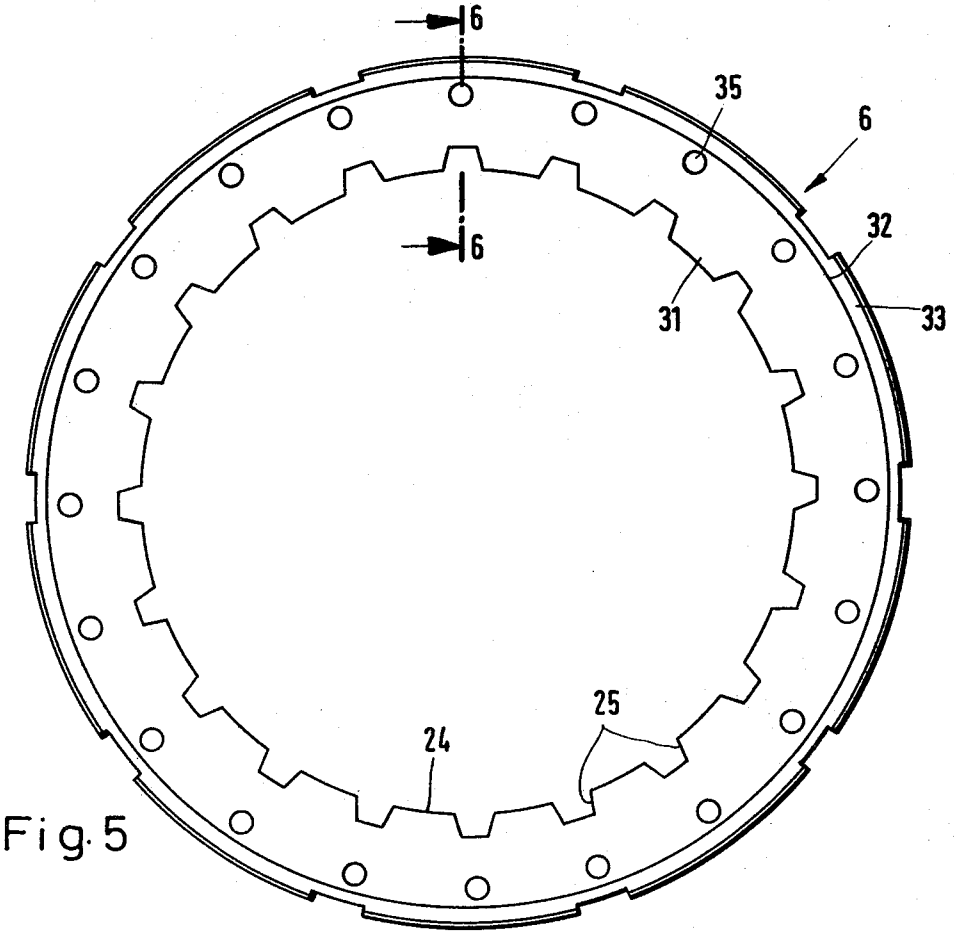
FIG. 5 is an exact illustration of a type ring.

On the portion 19*a* of the support body 19 type rings 6 are mounted whose exact structure is apparent from FIGS. 5 and 6. As apparent in FIG. 5 the internal peripheral surface 24 is provided with recesses 25 into which teeth 26 on the pinion 21 engage. This is shown in FIG. 3. According to FIG. 4 the pinion 21 can be displaced parallel to the axis of the print wheel so that it can be brought into engagement with any of the type rings 6. By rotating the pinion 21 it is possible to rotate the type ring 6 disposed in engagement therewith in the peripheral direction of the print wheel 4 so that a desired bar code type 7 reaches the sector 16 of the print wheel, i.e. the point on the periphery of the print wheel 4 at which the types are disposed which are to produce an imprint on the pressure-sensitive label 9 to be imprinted.

In FIGS. 3 and 4 in dash line a clear text printing mechanism 27 is illustrated which is connected fixed in rotation with the print wheel 4 and which is only present when a clear text imprint 3 according to FIG. 1 is also to be produced on the pressure-sensitive label 9 in addition to the bar code imprint 2. This clear text printing mechanism has a substantially conventional construction as known for example from U.S. Pat. No. 3,952,652. In particular, this printing mechanism includes type tapes 28 which carry clear character types 29. With the aid of a setting button 30 the type tapes can be moved so that the desired tapes 29 are located in a printing position at the peripheral surface of the print wheel 4. However, in contrast to the known clear text printing mechanism the types 29 disposed in the printing position lie adjacent each other in the peripheral direction of the type rings 6 and the print faces of the types 29 on the type tapes 28 are made as circular cylindrical faces to match the circular cylindrical peripheral surface of the type rings 6. In this manner a neat rolling of the types 29 on the pressure-sensitive label 9 to be imprinted is achieved.

The type rings 6, of which one is illustrated in FIGS. 5 and 6, comprise an inner ring 31 which can consist of aluminium or a duroplast. Formed at the circular cylindrical peripheral surface 32 of the inner ring 31 is an outer ring 33 of resilient material, that is a polymer material such as polyester or polyurethane. This resilient material can be formed on the peripheral surface 32 of the inner ring 31 in an injection moulding process. To ensure a firm connection between the inner ring 31 and the outer ring 33 anchoring recesses 34 are formed in the peripheral surface 32 and the material of the outer ring 33 penetrates into said recesses during the moulding on. In addition, near the periphery of the inner ring holes 35 are formed which communicate with the anchoring recesses 34. The material of the outer ring 33 also penetrates into said holes 35 to achieve a firm cohesion between the inner ring 31 and the outer ring 33.

Formed on the circular cylindrical peripheral surface of the outer ring 33 are bar code types 7 which are illustrated in section in FIG. 6. Said bar code types 7 produce the desired bar code imprint on the pressure-sensitive label to be imprinted, each bar code group on a type ring representing a certain number.

The circular cylindrical peripheral face of the type rings 6 may be achieved with great accuracy by grinding with simple means. The downwardly directed print faces of the bar code types of adjacent type rings thus lie with great accuracy in the same plane. The grinding also has the advantage that the edge radii on the bar code types necessarily arising when using the injection moulding process for applying the outer ring 33 are removed so that rectilinear and sharp-edge imprints are obtained on the pressure-sensitive labels.

The pressure roller 11 is of non-resilient material, for example a non-resilient plastic. This is possible because of the low height tolerances and the resiliency of the bar code types 7. The application pressure produced by the leaf springs 14 is great enough to easily compensate any small level differences of the bar code types 7 which might possibly be present. Thus, when the bar code types 7 are rolled along a pressure-sensitive label 9 to be imprinted uniformly inked high-contrast imprints can be achieved.

The cycle of the printing operation is best understood on consideration of FIG. 2. If a pressure-sensitive label 9 is to be provided with a certain imprint the individual type rings 7 are rotated with the aid of the pinions 21 so that the bar code types 7 which are to produce an imprint come to lie at the segment 16 of the print wheel 4. In addition, the clear text printing mechanism 27 can be set so that the desired clear text imprint is obtained. The print wheel 4 is now rotated with the aid of a means not illustrated in the anticlockwise direction and as a result via the connection of the tooth wheel 17 on the print wheel 4 and the toothed wheel 18 on the pressure roller 11 the latter is rotated in the clockwise direction. Immediately after commencement of the rotational movement of the pressure roller 11 the peripheral portion **11*b* moves into a position opposite the print wheel 4. Due to the supporting of the shaft 12 of the pressure roller 11 at the bearing surface 15 of the printing mechanism housing 13 the leaf springs 14 cannot press the pressure roller 11 further against the print wheel 4 so that a gap remains between the peripheral surface of the print wheel 4 and the peripheral surface of the pressure roller 11. Consequently, in this operating phase the carrier tape 10 and the pressure-sensitive labels 9 adhering thereto are not pressed against the peripheral surface of the print wheel 4**.

At the same time the inking means 8 starts to freshly ink the bar code types 7 disposed in the segment 16.

When the segment 16 reaches the position opposite the pressure roller 11 said roller has rotated in the clockwise direction to such an extent that the peripheral portion **11*a* is in the location opposite the print wheel 4 and starts to press the carrier tape 10 and the pressure-sensitive label 9 disposed thereon against the print wheel 4. On further rotation of the print wheel 4 the carrier tape 10 and the pressure-sensitive label 9 are entrained by the rolling engagement of the peripheral surfaces of the print wheel 4 and the pressure roller 11 in the illustration of FIG. 2** from the left to the right, the bar code imprint and the clear text imprint being produced simultaneously.

Even when the imprinted pressure-sensitive label has already been completely moved past the engagement point between the print wheel 4 and the pressure roller 1 the carrier tape 10 is still pressed by the peripheral portion **11*a* of the pressure roller 11 against the peripheral surface of the print wheel 4 so that a relative displacement between the print wheel 4 and the carrier tape 10 is prevented. The pressure-sensitive label 9 has now been provided with a bar code imprint 2 and a clear text imprint 3 as illustrated in FIG. 1**.

The print wheel 4 is now rotated in the opposite direction, i.e. clockwise, so that the printing operation outlined is repeated but with opposite directions of movement. This means that the segment 16 with the types again rolls along the already imprinted pressure-sensitive label 9, contributing to an improvement in the print quality. As soon as the print wheel 4 and the pressure roller 11 have reached the starting position illustrated in FIG. 2 the rotational movement of the print wheel 4 terminates. A feed means not illustrated can now guide the carrier tape with the imprinted pressure-sensitive label up to a peel edge at which the pressure-sensitive label 9 detaches from the carrier tape 10 so that it can be applied to an article. This movement of the carrier tape can easily be conducted because as already mentioned in the basic position the pressure roller 11 does not press the carrier tape 10 with the pressure-sensitive labels 9 against the peripheral surface of the print wheel 4. The feed means then moves the carrier tape 10 again into a position such that the next pressure-sensitive label to be imprinted assumes a position adjacent the engagement point between the print wheel 4 and the pressure roller 11.

The printing mechanism described is suitable for installation into a hand labelling apparatus with the aid of which goods in supermarkets and the like can be provided with pressure-sensitive labels. It could however readily also be inserted stationary on a conveying belt where the articles to be transported on the belt are to be provided with an imprinted pressure-sensitive label.

The rolling of the print types over the pressure-sensitive label 9 twice is not absolutely essential because a single rolling already produces a satisfactorily readable imprint which meets all the requirements made of bar code imprints which are to be read automatically. The second rolling-over results when the return of the components participating in the printing after the first rolling over into the basic position is achieved by reversal of the drive direction of the print wheel 4. It is however readily possible to reach the basic portion of FIG. 2 again by allowing the print wheel 4 to execute a complete revolution through 360° in each printing cycle. However, in this case it must be ensured that the pressure roller 11 also rotates only once through 360° during a printing cycle so that only one pressure-sensitive label 9, that is the label to be imprinted, is pressed against the print wheel peripheral surface in the course of a printing cycle. This could for example be achieved by providing instead of the toothed wheel 17 on the print wheel 4 only a toothed segment of such a length that its engagement with the toothed wheel 18 on the pressure roller 11 terminates when the latter has rotated once through 360°. This would mean that after completely rotating once and having pressed a pressure-sensitive label 9 against the segment 16 on the print wheel 4 the pressure roller 11 remains stationary whilst the print wheel 4 moves further until it has again reached its basic position illustrated in FIG. 2. The engagement of the toothed segment on the print wheel 4 also just starts in the basic position of the components participating in the printing operation illustrated in FIG. 2.

Figure 8:
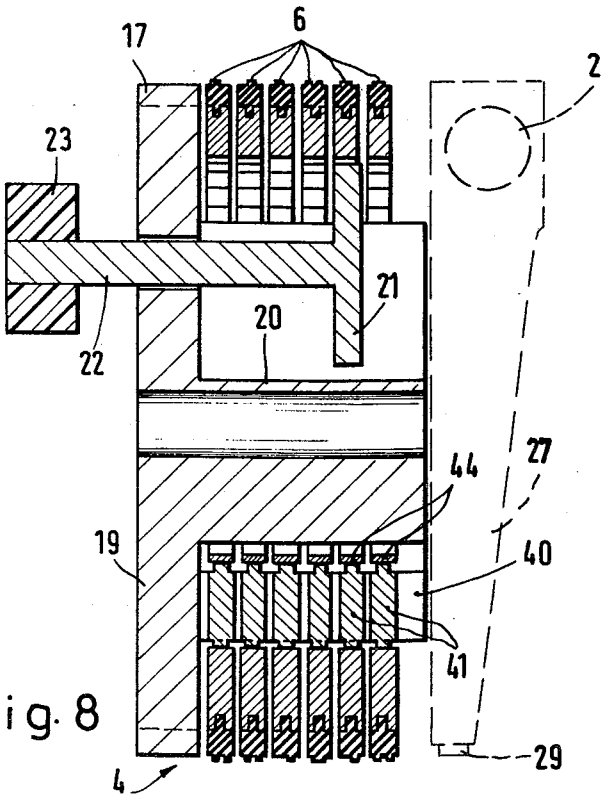
FIG. 8 is a section along the line 8—8 of FIG. 7
Figure 9:
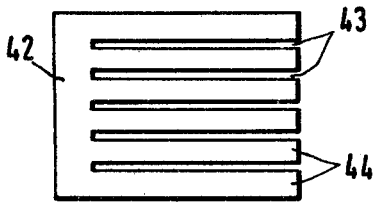
FIG. 9 is a plan view of the spring comb used according to FIGS. 7 and 8.

If it is desired to reduce the considerable accuracy demands in the production of the type rings 6 and the support body 19 a means can be used in the print wheel 4 which serves for tolerance compensation and will now be explained with reference to FIGS. 7 to 9.

Figure 7:
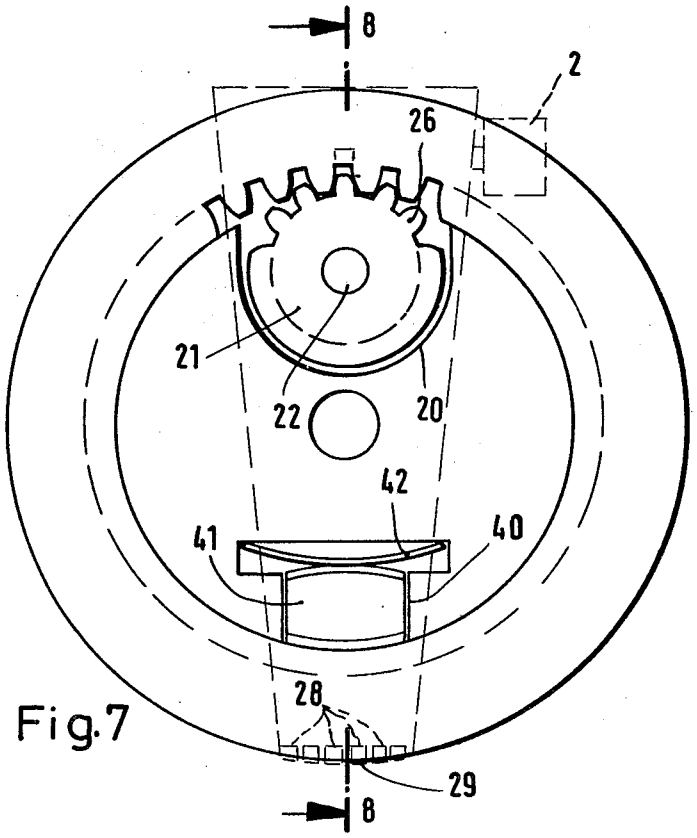
FIG. 7 is a schematic side view of a further embodiment of the print wheel of the printing mechanism according to the invention.

As apparent in FIG. 7 in the support body 19 a recess 40 is disposed in which pressure members 41 are located which are each associated with a type ring and lie in a plane with the associated type ring. The arrangement of the pressure members 41 with respect to the type rings 6 is shown in FIG. 8. In the portion of the recess 40 near the axis of the print wheel 4 there is a spring comb 42 which is illustrated in FIG. 9. The spring comb 42 comprises a spring sheet metal member into which cuts 43 are made to form individual spring prongs 44. The spring comb 42 in the relaxed condition is somewhat longer than the width of the portion of the recess 40 accommodating said comb so that the comb can be introduced into this portion of the recess 40 only in a slightly curved condition as shown in FIG. 7. In the installed condition the spring comb 42 is therefore biassed in the direction towards the pressure members 41 so that it holds the pressure members 41 positively in engagement with the type rings 6.

If due to greater production tolerances the end faces of the bar code types 7 on the type rings 6 are not exactly in a plane, the individual spring prongs 44 of the spring comb 42 ensure via the respective pressure members 41 that the bar code types 7 are nevertheless held uniformly in engagement with the pressure roller 11 so that a uniform bar code imprint 2 is produced on a pressure-sensitive label 1 led between the print wheel 4 and the pressure roller 11. The spring action of the individual type wheels also has the advantage that a wear with time of the material used for the bar code types 7 does not impair the print quality.

What we claim is:

1. A printing mechanism for printing bar codes on pressure-sensitive labels adhering to a carrier tape comprising a print wheel including a plurality of type rings rotatable relatively to each other about a common axis and a pressure roller for pressing the carrier tape with the pressure-sensitive label adhered thereto against the print wheel, wherein the type rings have a circular cylindrical peripheral surface at which bar code types of resilient material are formed, an inking means is in contact with the bar code types to be printed and the pressure roller is rotatable about an axis which is parallel to the axis of the type rings and consists of non-resilient material, a recess having a predetermined width disposed in the print wheel, a spring comb disposed in the recess where the spring comb has a plurality of spring prongs, a plurality of pressure members respectively disposed between said plurality of spring prongs and said plurality of type rings, the length of said spring comb in a relaxed condition thereof is greater than the predetermined width of the recess so that, when the comb is disposed in the recess, a slight curvature is introduced into the comb whereby each spring prong exerts on its associated type ring a force directed against the pressure roller.

2. A printing mechanism as claimed in claim 1 wherein the type rings include an inner ring of non-resilient material on which an outer ring forming the circular cylindrical peripheral surface of the type ring is formed from the resilient material.

3. A printing mechanism as claimed in claim 2 wherein the inner ring comprises a circular cylindrical peripheral surface onto which the material forming the outer ring is injection moulded.

4. A printing mechanism as claimed in claim 3 wherein in the peripheral surface of the inner ring anchoring recesses are disposed for the moulded-on material of the outer ring.

5. A printing mechanism as claimed in claim 2, 3 or 4 wherein the inner ring consists of aluminium.

6. A printing mechanism as claimed in claim 2, 3 or 4 wherein the inner ring consists of duroplast.

7. A printing mechanism as claimed in claim 2 wherein the outer ring consists of polymer material.

8. A printing mechanism as claimed in claim 7 wherein the polymer material is polyurethane.

9. A printing mechanism as claimed in claim 7 wherein the polymer material is polyester.

10. A printing mechanism as claimed in claim 1 wherein the pressure roller is spring loaded in the direction towards the peripheral surface of the type rings.

11. A printing mechanism as claimed in claim 1 wherein the print wheel is drivable for rotation about the axis of the type rings, a toothed wheel is rigidly connected to the print wheel and a further toothed wheel is rigidly connected to the pressure roller and meshes with said first toothed wheel on the print wheel.

12. A printing mechanism according to claim 1 wherein a clear text printing mechanism with type ribbons is connected to the printing wheel in such a manner that the clear text types at the circular cylindrical peripheral surface of the type rings disposed in a printing position lie adjacent each other in the peripheral direction of the type rings.

13. A printing mechanism as claimed in claim 12 wherein the printing face of the clear text types on the type ribbons are circular cylindrical faces for adaptation to the circular cylindrical peripheral surface of the type rings.

* * * * *